US005985211A

United States Patent [19]

Jeong et al.

[11] Patent Number: 5,985,211

[45] Date of Patent: Nov. 16, 1999

[54] COMPOSITION OF ZIRCONIUM ALLOY HAVING LOW CORROSION RATE AND HIGH STRENGTH

[75] Inventors: Yong Hwan Jeong; Jong Hyuk Baek; Byong Kwon Choi; Kyeong Ho Kim; Sun Jae Kim; Youn Ho Jung; Il Hiun Kuk, all of Taejon-si, Rep. of Korea

[73] Assignees: Korea Atomic Energy Research Institute, Taejon-si, Rep. of Korea; Korea Electric Power Corporation, Seoul, Rep. of Korea

[ * ] Notice: This patent is subject to a terminal disclaimer.

[21] Appl. No.: 09/096,660

[22] Filed: Jun. 12, 1998

[30] Foreign Application Priority Data

Feb. 4, 1998 [KR] Rep. of Korea ..... 98-3135

[51] Int. Cl.[6] ..... C22C 16/00

[52] U.S. Cl. ..... 420/423; 420/422; 148/421

[58] Field of Search ..... 148/421; 420/422, 420/423

[56] References Cited

U.S. PATENT DOCUMENTS

| | | | |
|---|---|---|---|
| 4,879,093 | 11/1989 | Garde | 420/422 |
| 4,992,240 | 2/1991 | Komatsu et al. | 420/422 |
| 5,080,861 | 1/1992 | Garde | 420/422 |
| 5,196,163 | 3/1993 | Matsuo et al. | 420/422 |
| 5,211,774 | 5/1993 | Garde et al. | 148/421 |
| 5,254,308 | 10/1993 | Garde et al. | 420/422 |
| 5,278,882 | 1/1994 | Garde et al. | 376/416 |
| 5,560,790 | 10/1996 | Nikulina et al. | 148/421 |

*Primary Examiner*—John Sheehan
*Attorney, Agent, or Firm*—Dilworth & Barrese

[57] ABSTRACT

The present invention is directed to an advanced zirconium alloy having superior corrosion resistance and high strength suitable for fuel rod cladding, spacer grids and other structural components in a reactor core of nuclear power plants.

9 Claims, No Drawings

COMPOSITION OF ZIRCONIUM ALLOY HAVING LOW CORROSION RATE AND HIGH STRENGTH

BACKGROUND OF THE INVENTION

The invention presented herein relates to the composition of zirconium(Zr) alloy having superior corrosion resistance and high strength. In particular, this invention relates to the alloys with superior corrosion resistance and high strength for fuel claddings, spacer grids, and core structural components in light water reactor(LWR) and heavy water reactor (HWR).

Zirconium alloys, in particular Zircaloy-2 and Zircaloy-4, have been widely used as fuel rod cladding and structural elements of nuclear reactor core.

The development of zirconium alloys is illustrated as follows: Zircaloy-1(Sn: 2.5 wt. %, Zr: the balance); Zircaloy-2(Sn: 1.20–1.70 wt. %, Fe: 0.07–0.20 wt. %, Cr: 0.05–1.15 wt. %, Ni: 0.03–0.08 wt. %, O: 900–1500 ppm, Zr: the balance; wherein, Fe+Cr+Ni: 0.16–1.70 wt. %); Zircaloy-3A(Sn: 2.5 wt. %, Fe: 0.25 wt. %, Zr: the balance); Zircaloy-3B(Sn: 0.5 wt. %, Fe: 0.4 wt. %, Zr: the balance); Zircaloy-3C(Sn: 0.5 wt. %, Fe: 0.2 wt. %, Ni: 0.2 wt. %, Zr: the balance); Zircaloy-4(Sn: 1.20–1.70 wt. %, Fe: 0.18–0.24 wt. %, Cr: 0.07–0.13 wt. %, O: 900–1500 ppm, Ni: <0.07 wt. %, Zr: the balance, wherein Fe+Cr: 0.28–0.24 wt. %); and so forth. The above alloys, except for Zircaloy-2 and Zircaloy-4, have not been commercialized due to poor mechanical strength and corrosion resistance in the reactor.

As the operating conditions of nuclear power plants tend to be at high burnup, increased operating temperature, and high pH, Zircaloys could not be utilized as fuel rod cladding. Recently, the extensive and successful research and development have been focused on increasing the corrosion resistance of zirconium alloys.

U.S. Pat. No. 4,649,023 relates to the zirconium alloys, which comprise the following alloy composition, and the manufacturing process of the intermediate and final product thereof.

niobium, in a range of 0.5 to 2.0 wt. %;

tin , up to 1.5 wt. %;

a third alloying element, up to 0.25 wt. %; and the balance being zirconium. The third alloying element is one of constituent such as iron, chromium, molybdenum, vanadium, copper and tungsten.

This alloy is characterized to have the a microstructure with homogeneously dispersed fine precipitates of less than about 800 Å. This was included to improve corrosion resistance in high temperature steam by controlling its microstructure.

The zirconium alloy with similar corrosion resistance to that in U.S. Pat. No. 4,649,023 is suggested in U.S. Pat. Nos. 5,112,573 and 5,230,758. This alloy includes niobium in a range of 0.5 to 2.0 wt. %, tin in a range of 0.7 to 1.5 wt. %, iron in a range of 0.07 to 0.14 wt. %, at least one of nickel and chromium in a range of 0.03 to 0.14 wt. %, and carbon up to 220 ppm, wherein the total amount of nickel and chromium is at least 0.12 wt. %. And, corrosion resistance is improved by chromium and nickel in a range of 0.03 to 0.08 wt. %.

U.S. Pat. No. 4,879,093 discloses improvement of corrosion resistance and ductility by adding up to 0.6 wt. % of niobium or up to 0.1 wt. % of molybdenum in the Zircaloy. The amount of oxygen was in a range of 1000 to 1600 ppm, and the second-phase was in a range of 1200 to 1800 Å.

The zirconium alloy of U.S. Pat. No. 5,080,861, the invention with improved corrosion resistance in the reactor core of nuclear power plant, includes up to 0.6 wt. % of niobium, up to 0.2 wt. % of antimony, up to 0.2 wt. % of tellurium, tin in a range of 0.5 to 1.0 wt. %, iron in a range of 0.8 to 0.24 wt. %, chromium in a range of 0.07 to 0.13 wt. %, oxygen in a range of 900 to 2000 ppm, less than 70 ppm of nickel, and less than 200 ppm of carbon. This alloy consists of α-phase in which the second phase in the size of 1200 to 1800 Å is somewhat precipitated, and may include up to 0.2 wt. % of silicon instead of tellurium and arsenic (As).

The improved zirconium alloy based on the above patent, U.S. Pat. No. 5,080,861, was additionally issued in U.S. Pat. No. 5,211,774. This alloy, which has a similar alloy composition to that in the above patent, has improved properties in ductility, creep strength and corrosion resistance because of the stabilized α-phase. It comprises an alloying composition as follows:

tin, in a range of 0.8 to 1.2 wt. %;

iron, in a range of 0.2 to 0.5 wt. % (typically 0.35 wt. %);

chromium, in a range of 0.1 to 0.4 wt. % (typically 0.25 wt. %);

niobium up to 0.6 wt. % (typically up to 0.3 wt. %);

silicon, in a range of 50 to 200 ppm (typically 100 ppm);

oxygen, in a range of 900 to 1800 ppm (typically 1600 ppm); and the balance being of zirconium.

In this alloy, silicon decreases hydrogen uptake, and increases corrosion resistance.

U.S. Pat. No. 5,244,514 also discloses the zirconium alloy having stabilized precipitates, which are formed when the alloy is exposed to thermal neutron as well as high temperatures. This alloy includes a smaller amount of tin as compared with the former existing Zircaloys, and has a low capture cross section of thermal neutrons, superior corrosion resistance, low hydrogen uptake, good workability and improved creep resistance. This alloy is composed of vanadium up to 1.0 wt. %, up to 1.0 wt. % of niobium, up to 0.2 wt. % of antimony and tellurium, up to 0.5 wt. % of tin, iron in a range of 0.2 to 0.5 wt. %, chromium in a range of 0.1 to 0.4 wt. %, silicon in a range of 50 to 200 ppm, up to 2200 ppm of oxygen, and the balance being of zirconium. The vanadium compound($ZrV_2$), which is the precipitate formed in this alloy provides good creep resistance, low hydrogen uptake, and stability in neutron flux and in high burn-up.

U.S. Pat. No. 4,963,323 discloses the material for fuel cladding with improved corrosion resistance by adjusting the composition of the former existing Zircaloy-4. That is, the amount of tin was decreased and noibium was added as compensation, and the amount of nitrogen was controlled to less than 60 ppm in this alloy. Therefore, the alloy included tin in a range of 0.2 to 1.15 wt. %, iron in a range of 0.19 to 0.6 wt. % (typically 0.19 to 0.24 wt. %), chromium in a range of 0.07 to 0.4 wt. % (typically in a range of 0.07 to 0.4 wt. %), niobium in a range of 0.05 to 0.5 wt. %, and less than 60 ppm of nitrogen.

U.S. Pat. No. 5,017,336 discloses the improved Zircaloy-4 with niobium, tantalum(Ta), vanadium, and molybdenum, and this alloy comprises an alloy composition as follows:

tin, in a range of 0.2 to 0.9 wt. %;

iron, in a range of 0.18 to 0.6 wt. %;

chromium, in a range of 0.07 to 0.4 wt. %;

niobium, in a range of 0.05 to 0.5 wt. %;

tantalum, in a range of 0.01 to 0.2 wt. %;

vanadium, in a range of 0.05 to 1 wt. %;

molybdenum, in a range of 0.05 to 1 wt. %; and the balance being of zirconium.

U.S. Pat. No. 5,196,163 discloses the improved zirconium alloy containing tantalum as well as the usual components which are tin, iron and chromium, but also with tantalum, and selectively, niobium, and the alloy composition is as follows:

tin, in a range of 0.2 to 1.15 wt. %;

iron, in a range of 0.19 to 0.6 wt. % (typically in a range of 0.19 to 0.24 wt. %);

chromium, in a range of 0.07 to 0.4 wt. % (typically in a range of 0.07 to 0.13 wt. %);

tantalum, in a range of 0.01 to 0.2 wt. %;

niobium, in a range of 0.05 to 0.5 wt. %;

nitrogen, in less than 60 ppm; and the balance being of zirconium.

U.S. Pat. No. 5,560,790 discloses the zirconium alloy, which comprises the following alloy composition.

Niobium, in a range of 0.5 to 1.5 wt. %;

tin, in a range of 0.9 to 1.5 wt. %;

iron, in a range of 0.3 to 0.6 wt. %;

chromium, in a range of 0.005 to 0.2 wt. %;

carbon, in a range of 0.005 to 0.04 wt. %;

oxygen, in a range of 0.05 to 0.15 wt. %;

silicon, in a range of 0.005 to 0.15 wt. %; and the balance being of zirconium.

In this patent, the distance between the precipitates, Zr(Nb, Fe)2, Zr(Fe, Cr, Nb), and (Zr, Nb)3Fe, was limited to the range of 0.20 to 0.40 $\mu$m, and the volume of the precipitate containing iron was limited to 60% of the total volume of precipitate.

CA 2,082,691 describes the zirconium alloy maintaining ductility to the degree of sponge zirconium and corrosion resistance improved by adding bismuth in a range of 0.1 to 0.5 wt. % and niobium in a range of 0.1 to 0.5 wt. % (typically in a range of 0.1 to 0.3 wt. %).

The zirconium alloys are suitable for material used in fuel rod cladding because of the small capture cross section of thermal neutron and relatively good corrosion resistance at high temperature. The zirconium alloy for the present fuel rod cladding is Zircaloys with tin, iron, chromium, and nickel.

However, considering the circumstances of the extended and high burn-up fuel, the use of Zircaloys as material for fuel rod cladding becomes limited due to enhanced corrosion and irradiation creep. Therefore, the development of an advanced zirconium alloy with high strength and corrosion resistance has been required.

We, the inventors of this invention, successfully developed a zirconium alloy with higher strength and superior corrosion resistance than the former existing Zircaloys through making changes in the kinds and amounts of alloying elements.

SUMMARY OF THE INVENTION

It is the objective of this invention to provide an advanced zirconium alloy with superior corrosion resistance and high strength suitable for the material used in fuel rod cladding, spacer grid, and other structural components in the reactor core of nuclear power plants.

DESCRIPTION OF THE PREFERRED EMBODIMENTS

In order to attain the above objective, the zirconium alloy with superior corrosion resistance and high strength according to the present invention comprises niobium in a range of 0.3 to 0.6 wt. %; tin in a range of 0.7 to 1.0 wt. %; a selected element from the group consisted of iron, vanadium, antimony, molybdenum, tantalum, copper, bismuth and manganese in a range of 0.05 to 0.4 wt. %; and oxygen in a range of 600 to 1400 ppm.

Also, the zirconium alloy according to the present invention comprises niobium in a range of 0.3 to 0.6 wt. %; tin in a range of 0.7 to 1.0 wt. %; iron in a range of 0.2 to 0.5 wt. %; a selected element from the group consisted of vanadium, antimony, molybdenum, tantalum, copper, bismuth and manganese in a range of 0.05 to 0.4 wt. %; and oxygen in a range of 600 to 1400 ppm.

Still also, the zirconium alloy according to the present invention comprises niobium in a range of 0.3 to 0.6 wt. %; tin in a range of 0.7 to 1.0 wt. %; iron in a range of 0.2 to 0.5 wt. %; chromium in a range of 0.05 to 0.25 wt. %; a selected element from the group consisted of tellurium, copper, gallium, zinc, bismuth and manganese in a range of 0.05 to 0.4 wt. %; and oxygen in a range of 600 to 1400 ppm.

The present invention will now be described in detail.

The zirconium alloy of this invention may be utilized as a material for fuel rod claddings, spacer grids, and other structural components in the reactor core of nuclear power plants. The composition of this zirconium alloy is shown in Table I.

TABLE I

| Alloy system | Range of the alloying elements | | | | | | |
|---|---|---|---|---|---|---|---|
| | Nb (wt. %) | Sn (wt. %) | Fe (wt. %) | Cr (wt. %) | X (wt. %) | O (ppm) | Zr+ impurities |
| Zr—Nb—Sn—X | 0.3–0.6 | 0.7–1.0 | — | — | a) 0.05–0.4 | 600–1400 | the balance |
| Zr—Nb—Sn—Fe—X | 0.3–0.6 | 0.7–1.0 | 0.2–0.5 | — | b) 0.05–0.4 | 600–1400 | the balance |
| Zr—Nb—Sn—Fe—Cr—X | 0.3–0.6 | 0.7–1.0 | 0.2–0.5 | 0.05–0.25 | c) 0.05–0.4 | 600–1400 | the balance |

a) a selected element from the group consisted of Fe, V, Sb, Mo, Ta, Cu, Bi and Mn.
b) a selected element from the group consisted of V, Sb, Mo, Ta, Cu, Bi and Mn.
c) a selected element from the group consisted of Te, Cu, Ga, Zn, Bi and Mn.

Mostly, the corrosion acceleration and secondly the irradiation creep and growth are the main concerns in high burn-up fuel cladding. Therefore, this invention mainly aims at improving corrosion resistance of zirconium alloy. The neutron effect, manufacturing cost and workability were considered in selecting the alloying elements, then the effects of each alloying element on corrosion resistance, mechanical properties and creep behavior were evaluated in detail. And then, the alloy system for this invention and the amount of each of the alloying elements were also determined.

The above factors are described in detail as follows:

(1) Neutron Effect

Neutron absorption is the most important of the above factors. The alloying elements having high absorption cross section of neutron were excluded due to neutron inefficiency. Therefore, zirconium was selected as a base element in this invention. The neutron absorption of alloying elements added to the base zirconium was also considered in this invention.

(2) Cost and Usefulness

The alloying elements need to be readily available at a reasonable cost. And they must be easily alloyed with zirconium. Vapor pressure of the elements is also considered in selecting the alloying elements.

(3) Corrosion Resistance

Corrosion of material used in the reactor core is a serious problem, as it is constaantly in contact with high temperature and high pressure water. In the view of corrosion resistance, the valence compatibility between zirconium base and alloying elements should be considered. In general, a supervalent element is known to improve corrosion resistance. Also, the difference between ionic radius of zirconium base and those of alloying elements should be small. When there is a significant difference in the ionic radius, the local stress in the oxide accelerates the penetration of hydrogen and oxygen. The above mentioned factors are generally considered when selecting alloying elements. In this invention, niobium and tin are the major alloying elements, and iron, chromium, vanadium, molybdenum, tellurium, antimony, tantalum and copper were added to improve the corrosion resistance and strength.

(4) Effects of Major Alloying Elements (a) Niobium(Nb)

Niobium is known to stabilize β-phase of zirconium. It is said that corrosion resistance and workability of the material is improved when niobium less than 0.5 wt. % is added. But, it is also said that zirconium alloy has superior corrosion resistance when 1.0 wt. % of niobium is added. Niobium is known as a useful element when hydrogen uptake and strength are considered. Because the alloys containing high concentration of niobium are sensitive to heat treatment condition, niobium is added less than 0.6 wt. % in this invention.

(b) Tin(Sn)

Tin stabilizes α-phase of zirconium, and increases its strength. With a small amount of tin, the desired strength and creep resistance cannot be attained. When determining the optimal amount of tin, it is preferred that it be increased the corrosion resistance be increased. As the amount of tin is decreased to improve the corrosion resistance, other alloying elements need to be added in exchange to maintain the strength instead of tin. The amount of tin in this invention is in the range of 0.7 wt. % to 1.0 wt. %.

(C) Iron(Fe) and chromium(Cr)

Iron and chromium are known to improve corrosion resistance. Iron decreases corrosion resistance when less than 0.18 wt. % or more than 0.6 wt. % is added. Inversely, iron improves the corrosion resistance when it is added in the range of 0.2 to 0.6 wt. %. There is a report that chromium has no relation to corrosion resistance. Iron and chromium are known to have no relation to strength and creep behavior, but have an effect on hydrogen uptake. In this invention, the amount of iron is added in the range of 0.05 to 0.5 wt. %, and chromium is added in the range of 0.05 to 0.25 wt. %.

(d) Vanadium(V)

Vanadium effectively improves strength and creep resistance, and has positive effect on hydrogen uptake. When less than 0.05 wt. % of vanadium is added, there is no effect on strength, creep resistance, or hydrogen uptake. When vanadium is added in more than 1 wt. %, the corrosion resistance of this alloy decreases. Therefore, vanadium is preferred when added in a range of 0.05 to 0.4 wt. %.

(e) Molybdenum(Mo)

Molybdenum effectively improves strength and creep resistance. However, less than 0.05 wt. % of molybdenum cannot improve strength nor creep resistance. More than 0.5 wt. % decreases corrosion resistance and elongation. Therefore, molybdenum is preferred when added in a range of 0.05 to 0.4 wt. %.

(f) Tellurium(Te) and antimony(Sb)

Tellurium and antimony are known to improve corrosion resistance when added in a small amount, and has positive effects on hydrogen uptake. A small amount of antimony does not form precipitates due to the high solubility of 1.9 wt. % in the zirconium. Antimony also increases the solubility of hydrogen. Therefore, tellurium and antimony are preferred when added in a range of 0.05 to 0.4 wt. %.

(g) Tantalum(Ta)

Tantalum is known to improve corrosion resistance, but when less than 0.01 wt. % is added there is no improvement in corrosion resistance, and corrosion resistance decreases when more than 0.4 wt. % is added. Furthermore, it is not preferable to add large amount because of its high neutron absorption cross section (21 barn).

(h) Bismuth(Bi)

Bismuth is also known to improve corrosion resistance by adding a small amount. Corrosion resistance is effectively improved by adding bismuth in a range of 0.05 to 0.4 wt. %.

(i) Copper(Cu) and manganese(Mn)

Copper and manganese improve corrosion resistance when added in small quantities. Corrosion resistance improves when copper and manganese, in a range of 0.05 to 0.4 wt. %, is added.

(j) Oxygen(O)

Oxygen in a range of 600 to 1400 ppm is added to improve its mechanical strength by the solid solution hardening. However, workability decreases when oxygen is added in large amounts.

The zirconium alloy with superior corrosion and high strength was fabricated in consideration of the above mentioned factors.

For the purposes of illustration the invention has been described by referring to specific examples, but the present invention is not limited to the preferred embodiments.

EXAMPLES

In total, twenty-one kinds of zirconium alloys according to the present invention have been described, hereinafter. The manufacturing process and the preferred embodiments, also, have been described.

(I) Ingot Melting

The material with the composition shown in Table II was melted into a 200 g button form by vacuum arc remelting (VAR) method. This process is repeated 5 times to prevent the segregation and nonhomogeneous dispersion of alloying elements.

During the β-quenching process, the basketweave and parallel plate were formed in the cooled ingot. It was different from the dendrite structure, which is generally formed when manufacturing the large ingot. This may have resulted from the size of ingot being small and the cooling rate, high.

TABLE II

| Zirconium alloy No. | Alloy composition X* | Nb (wt. %) | Sn (wt. %) | Fe (wt. %) | Cr (wt. %) | X* (wt. %) | O (ppm) | Zr + impurities |
|---|---|---|---|---|---|---|---|---|
| 1 | — | 0.43 | 0.94 | 0.23 | — | — | 937 | the balance |
| 2 | V | 0.48 | 0.95 | — | — | 0.20 | 768 | the balance |
| 3 | Sb | 0.40 | 0.86 | — | — | 0.14 | 639 | the balance |
| 4 | Mo | 0.46 | 1.00 | — | — | 0.21 | 921 | the balance |
| 5 | Ta | 0.43 | 0.96 | — | — | 0.21 | 855 | the balance |
| 6 | Cu | 0.50 | 0.95 | — | — | 0.24 | 665 | the balance |
| 7 | Bi | 0.38 | 0.81 | — | — | 0.17 | 1045 | the balance |
| 8 | Mn | 0.51 | 0.94 | — | — | 0.14 | 757 | the balance |
| 9 | V | 0.40 | 0.87 | 0.40 | — | 0.19 | 1036 | the balance |
| 10 | Sb | 0.42 | 0.80 | 0.38 | — | 0.14 | 728 | the balance |
| 11 | Mo | 0.50 | 0.95 | 0.43 | — | 0.21 | 731 | the balance |
| 12 | Ta | 0.40 | 0.94 | 0.43 | — | 0.20 | 906 | the balance |
| 13 | Cu | 0.52 | 0.97 | 0.45 | — | 0.23 | 707 | the balance |
| 14 | Bi | 0.39 | 0.82 | 0.40 | — | 0.18 | 1085 | the balance |
| 15 | Mn | 0.43 | 0.84 | 0.38 | — | 0.13 | 719 | the balance |
| 16 | Te | 0.42 | 0.91 | 0.38 | 0.19 | 0.36 | 678 | the balance |
| 17 | Cu | 0.41 | 0.80 | 0.41 | 0.18 | 0.11 | 972 | the balance |
| 18 | Ga | 0.39 | 0.91 | 0.39 | 0.19 | 0.10 | 1310 | the balance |
| 19 | Zn | 0.43 | 0.82 | 0.39 | 0.19 | 0.10 | 737 | the balance |
| 20 | Bi | 0.40 | 0.87 | 0.41 | 0.19 | 0.10 | 884 | the balance |
| 21 | Mn | 0.42 | 0.87 | 0.43 | 0.19 | 0.10 | 937 | the balance |
| Zircaloy-4 | — | 1.53 | 0.21 | 0.11 | — | 1250 | the balance | |

*X: a selected element from the group consisted of V, Sb, Mo, Ta, Cu, Bi, Mn, Te, Ga and Zn.

(II) β-Heat Treatment

β-Heat treatment was performed by the solution treatment of ingot in β-region to homogenize the alloy composition. The sample was heated at 1050° C. for 30 minutes, and then cooled in water.

(III) Hot Rolling and Heat Treatment

After preheating the samples at 700° C. for 20 minutes, they were rolled by 70% of its thickness in one pass. The oxide scale which is formed in β-treating or hot rolling was removed with an acid pickling solution.

(IV) Cold Rolling and Heat Treatment

The sample was annealed at 700° C. for 2 hours to remove the remaining strain after hot rolling and to prevent the breakage of the sample, which may occur in cold working. The sample was first cold-rolled to reduce its thickness by 30%. After the first cold-rolling, the sample was annealed for recrystallization at 610° C. for 2 hours. The above process for annealing and cold-rolling was repeated three times. Final heat treatment was conducted at 480° C. for 3 hours.

Corrosion tests were performed in autoclave with an atmosphere of 360° C. of water and 400° C. of steam for 100 days. Corrosion rate was quantitatively estimated by measuring the weight gain of corroded sample. Tensile tests were also conducted by hydraulic tester with the tensile specimen at room temperature. Results of corrosion and tensile tests are shown in the following Table III.

TABLE III

| No. of alloy | Corrosion test (mg/dm$^2$) 360° C./water | 400° C./steam | Test on tensile strength (MPa) Y.S/room temperature | UTS/room temperature |
|---|---|---|---|---|
| 1 | 42.1 | 64.3 | 646 | 858 |
| 2 | 44.6 | 66.2 | 655 | 859 |
| 3 | 42.3 | 59.7 | 606 | 776 |
| 4 | 39.1 | 61.4 | 635 | 800 |
| 5 | 46.0 | 63.2 | — | — |
| 6 | 42.5 | 61.5 | 674 | 831 |
| 7 | 41.1 | 59.4 | 564 | 747 |
| 8 | 35.3 | 54.3 | 569 | 780 |
| 9 | 35.7 | 77.8 | 708 | 896 |
| 10 | 43.8 | 68.9 | 642 | 824 |
| 11 | 41.6 | 79.9 | — | — |
| 12 | 43.7 | 74.6 | — | — |
| 13 | 47.4 | 69.0 | — | — |
| 14 | 40.3 | 66.5 | 639 | 858 |
| 15 | 32.4 | 64.7 | 588 | 788 |
| 16 | 31.5 | 61.9 | 775 | 993 |
| 17 | 36.7 | 64.3 | 618 | 772 |
| 18 | 37.8 | 70.4 | — | — |
| 19 | 35.2 | 73.8 | — | — |
| 20 | 39.1 | 70.9 | 591 | 756 |
| 21 | 40.3 | 81.6 | — | — |
| Zircaloy-4 | — | 85.8 | 495 | 685 |

From the Table III, Zr—Nb—Sn—X alloys (wherein X may be one of iron, vanadium, antimony, molybdenum, tantalum, copper, bismuth and manganese.), shown as Nos. 1 to 8 in Table II, displayed a smaller increase in weight (higher corrosion resistance) and higher mechanical strength than the former existing Zircaloy-4, when adding the alloying elements in the range which was presented in this invention.

Zr—Nb—Sn—Fe—X alloys (wherein X may be one of vanadium, antimony, tantalum, copper, bismuth and manganese.), shown as Nos. 9 to 15 in Table II, displayed a smaller increase in weight (higher corrosion resistance) and higher mechanical strength than the former existing Zircaloy-4, when adding the alloying elements in the range which was presented in this invention.

Also, Zr—Nb—Sn—Fe—Cr—X alloys (wherein X may be one of tellurium, copper, gallium, zinc, bismuth and manganese.), shown as Nos. 16 to 21 in Table II, displayed a smaller increase in weight (higher corrosion resistance) and higher mechanical strength than the former existing Zircaloy-4, when adding the alloying elements in a range which was presented in this invention.

EFFECTS OF THE INVENTION

From the above example, it was found that the zirconium alloys of this invention displayed superior corrosion resistance and high mechanical strength. Therefore, the alloys of this invention can be utilized as fuel rod claddings, spacer grids and structural components, etc. in the reactor core of a nuclear power plants.

What is claimed is:

1. The zirconium alloy having low corrosion rate and high strength, which comprises an alloy composition as follows:

niobium(Nb), in a range of 0.3 to 0.6 wt. %;

tin(Sn), in a range of 0.7 to 1.0 wt. %;

at least one element selected from the group consisting of vanadium(V), antimony(Sb), tantalum (Ta), copper (Cu), bismuth(Bi) and manganese(Mn), in a range of 0.05 to 0.4 wt. %;

oxygen(O), in a range of 600 to 1400 ppm; and the balance being zirconium(Zr).

2. The zirconium alloy as set forth in claim 1, the zirconium alloy is characterized as comprising the alloy composition as follows:

0.4 wt. % of niobium;

0.8 wt. % of tin;

0.2 wt. % of a selected element from the group consisted of vanadium, antimony, tantalum, copper, bismuth and manganese;

oxygen, in a range of 600 to 1400 ppm; and the balance being zirconium.

3. The zirconium alloy having low corrosion rate and high strength, which comprises an alloy composition as follows:

niobium, in a range of 0.3 to 0.6 wt. %;

tin, in a range of 0.7 to 1.0 wt. %;

iron, in a range of 0.2 to 0.5 wt. %;

at least one element selected from the group consisting of vanadium (V), antimony(Sb), tantalum(Ta), copper (Cu), bismuth(Bi) and manganese(Mn), in a range of 0.05 to 0.4 wt. %;

oxygen, in a range of 600 to 1400 ppm; and the balance being zirconium.

4. The zirconium alloy as set forth in claim 3, the zirconium alloy is characterized as comprising the alloy composition as follows:

0.4 wt. % of niobium;

0.8 wt. % of tin;

0.4 wt. % of iron;

0.2 wt. % of a selected element from the group consisted of vanadium, antimony, tantalum, copper, bismuth and manganese;

oxygen, in a range of 600 to 1400 ppm; and the balance being zirconium.

5. The zirconium alloy having low corrosion rate and high strength, which comprises an alloy composition as follows:

niobium, in a range of 0.3 to 0.6 wt. %;

tin, in a range of 0.7 to 1.0 wt. %;

iron, in a range of 0.2 to 0.5 wt. %;

chromium, in a range of 0.05 to 0.25 wt. %;

a selected element from the group consisted of tellurium (Te), copper(Cu), gallium(Ga), zinc(Zn), bismuth(Bi) and manganese(Mn), in a range of 0.05 to 0.4 wt. %;

oxygen, in a range of 600 to 1400 ppm; and the balance being zirconium.

6. The zirconium alloy as set forth in claim 5, the zirconium alloy is characterized ascomprising the alloy composition as follows:

0.4 wt. % of niobium;

0.8 wt. % of tin;

0.4 wt. % of iron;

0.2 wt. % of chromium;

0.1 wt. % of a selected element from the group consisted of tellurium, copper, gallium, zinc, bismuth and manganese;

oxygen, in a range of 600 to 1400 ppm; and the balance being zirconium.

7. The alloy of claim 1 consisting of the enumerated ingredients.

8. The alloy of claim 3 consisting of the enumerated ingredients.

9. The alloy of claim 4 consisting of the enumerated ingredients.

* * * * *